United States Patent [19]

Perez

[11] Patent Number: 4,811,429

[45] Date of Patent: Mar. 14, 1989

[54] UNITARY SLEEPWEAR

[76] Inventor: Barbara Perez, 15069 Oro Grande St., Sylmar, Calif. 91342

[21] Appl. No.: 112,372

[22] Filed: Oct. 26, 1987

[51] Int. Cl.[4] ..... A41D 10/00

[52] U.S. Cl. ..... 2/83; 2/114; 2/80; 2/75; 2/70; 2/69; 2/69.5

[58] Field of Search ..... 2/70, 69.5, 75, 80, 2/83, 113, 114

[56] References Cited

U.S. PATENT DOCUMENTS

| | | | |
|---|---|---|---|
| 695,496 | 3/1902 | Schermerhorn | 2/114 |
| 818,351 | 4/1906 | Clark | 2/114 |
| 1,079,798 | 11/1913 | Painter | 2/83 X |
| 1,547,085 | 7/1925 | Tucker | 2/114 X |
| 1,915,044 | 6/1933 | Anderson | 2/69 |
| 2,325,097 | 7/1943 | Behringer | 2/114 X |
| 2,439,101 | 4/1948 | Rogers | 2/114 |
| 2,680,849 | 6/1954 | Munro | 2/83 X |
| 2,725,565 | 12/1955 | Wyner | 2/83 X |
| 2,929,072 | 3/1960 | Heilbronner | 2/83 |
| 3,106,717 | 10/1963 | Cuvin | 2/70 |
| 3,597,764 | 8/1971 | Povey | 2/69.5 |
| 3,812,539 | 5/1974 | Muehlberg et al. | 2/69.5 |
| 4,217,662 | 8/1980 | Buchman | 2/69.5 |

*Primary Examiner*—Werner H. Schroeder
*Assistant Examiner*—Jeanette E. Chapman
*Attorney, Agent, or Firm*—Allan M. Shapiro

[57] ABSTRACT

Two-piece unitary sleepwear comprises night garment which embraces at least the upper torso and shoulders of the wearer, usually a child, so as to cover the child for the night. The lower portion of the unitary sleepwear is a blanket which wraps around the lower torso of the child and detachably snaps to the night garment portion of the unitary sleepwear.

11 Claims, 1 Drawing Sheet

FIG. 1
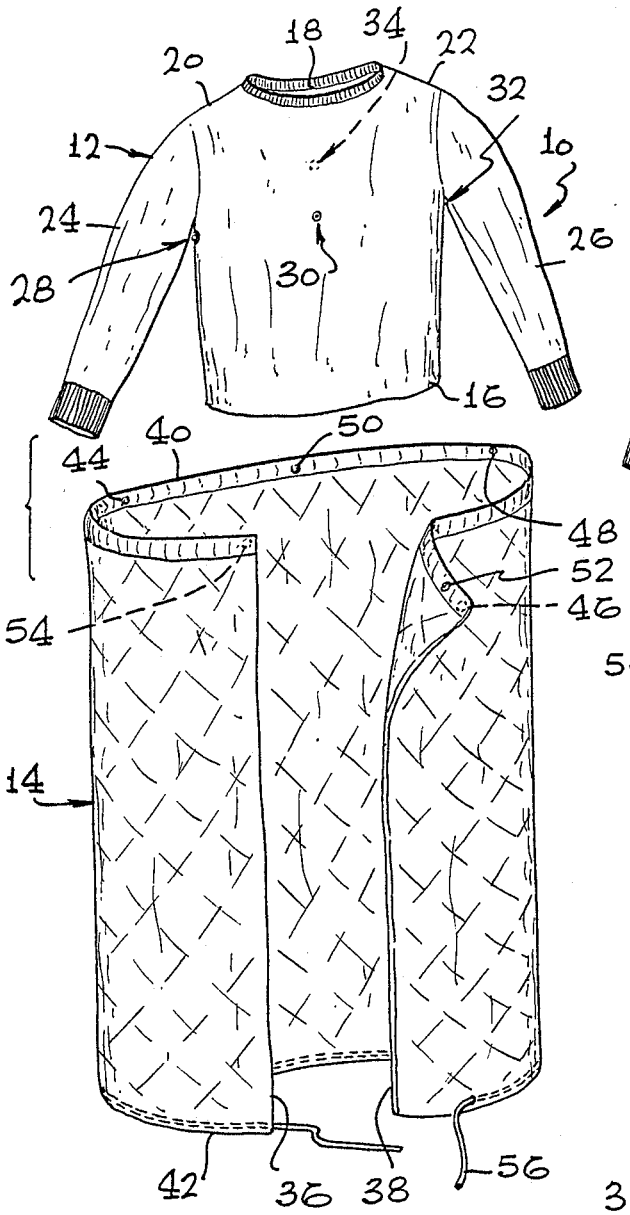
FIG. 3
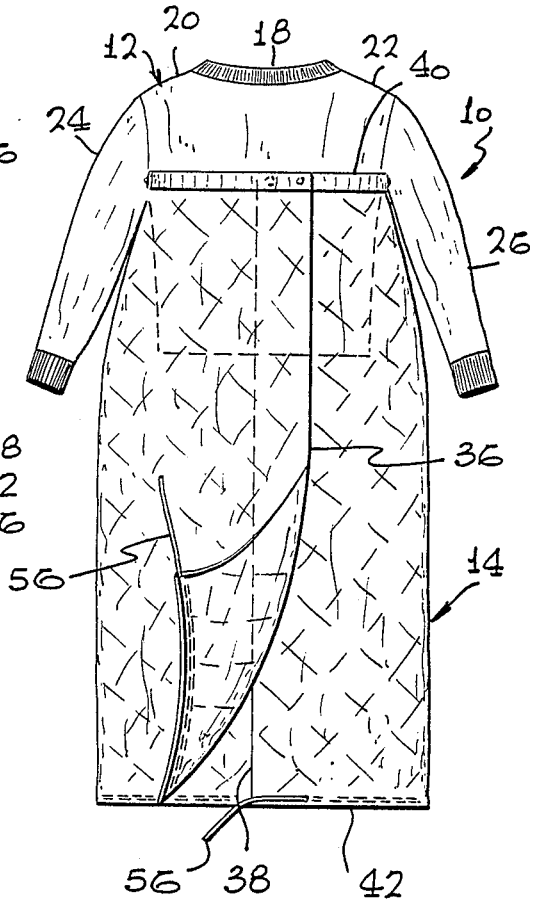
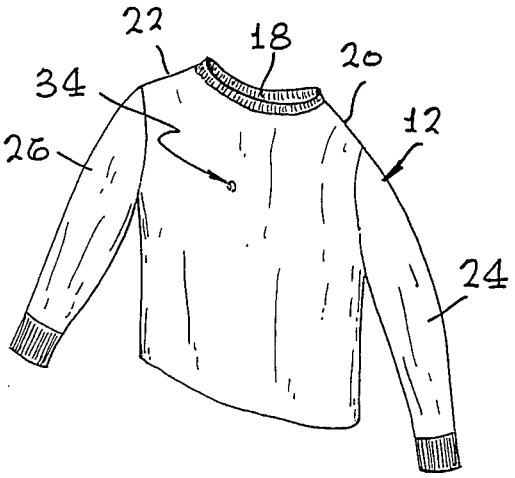
FIG. 2

UNITARY SLEEPWEAR

FIELD OF THE INVENTION

This invention is directed to unitary sleepwear particularly useful for children, wherein the upper night garment can detachably receive the blanket wrapped therearound.

BACKGROUND OF THE INVENTION

A person must be warm during the night in order to have a satisfactory night's sleep. The problem is greater in children who tend to throw off their blankets and who do not, during sleep, replace the blankets upon themselves. The metabolism is lower during sleep, which requires covering to maintain body temperature. This is complicated by the fact that most sleeping is at night when the temperatures are usually lower. Thus, proper covering is required for proper sleep.

This problem is addressed, particularly for children, by the provision of blankets which serve as a night garment by wrapping around and closing around the child. In other words, the blanket becomes a garment by wrapping it and closing it around the child. Such are not suitable for older children who have the freedom to get up at night, perhaps to go to the bathroom. Such children must be kept warm and also be provided with a garment which permits them to achieve mobility. The closing blankets do not permit this, but are designed for infants.

SUMMARY OF THE INVENTION

In order to aid in the understanding of this invention, it can be stated in essentially summary form that it is directed to unitary sleepwear which comprises two portions. The upper night garment is an upper body covering, and the lower portion is a blanket wrapped around and detachably attached to the night garment.

It is, thus, an object and advantage of this invention to provide unitary sleepwear which employs an upper night garment which embraces the torso and shoulders of the wearer, and possibly also the arms, and has a lower blanket-type portion detachably attached thereto to wrap around the lower portion of the wearer.

It is another object and advantage of this invention to provide unitary sleepwear which permits the wearer to be warm during the night and yet provides for mobility of the wearer.

It is a further object and advantage of this invention to provide unitary sleepwear wherein the upper night garment portion thereof may be worn during the evening and the lower blanket portion can be wrapped around and attached thereto when the wearer goes to bed.

It is another object and advantage of this invention to provide a unitary sleepwear, particularly for children, which provides them both warmth and mobility.

The features of the present invention which are believed to be novel are set forth with particularity in the appended claims. The present invention, both as to its organization and manner of operation, together with further objects and advantages thereof, may be best understood by reference to the following description, taken in conjunction with the accompanying drawings.

BRIEF DESCRIPTION OF THE DRAWINGS

FIG. 1 is an exploded rear view of the unitary sleepwear of this invention, showing the blanket separated from the night garment.

FIG. 2 is an isometric front view of the night garment portion.

FIG. 3 is a view similar to FIG. 1, showing a rear view of the unitary sleepwear with the two portions attached.

DESCRIPTION OF THE PREFERRED EMBODIMENT

The unitary sleepwear of this invention is generally indicated at 10 in FIGS. 1 and 3. The unitary sleepwear 10 has an upper night garment portion 12 and a lower blanket portion 14. The night garment is also shown in FIG. 2 as a perspective front view thereof. The night garment 12 is shown as a short pajama top which may be made of a suitable night garment material, such as flannel. It has a torso 16 which may open in the front or the back to aid in donning or removing the night garment from the wearer. However, in the present instance, the torso is sufficiently large that the night garment may be pulled down over the head of the wearer. Neck opening 18 is positioned between shoulders 20 and 22. The night garment may be longer than shown to resemble a nightgown.

While sleeves are not required for the purposes of this invention, they are usually present on a garment intended for keeping a wearer warm during the night. In such a garment, sleeves are considered to be important features. Therefore, the night garment 12 is shown as having sleeves 24 and 26. From this construction, it can be seen that the night garment portion 12 of the unitary sleepwear 10 is similar to the upper portion of a pajama or nightgown. The torso of the night garment can be of any convenient length, such as extending down from waist to knee level. The characteristic of the night garment 12 of the unitary sleepwear which makes it cooperative with the lower, blanket portion is the provision of detachable snaps. Snaps 28, 30 and 32 are shown in FIG. 1, and snap 34 is shown in the front of the night garment in FIG. 2. These snaps are halves of detachable snap fasteners.

The blanket portion of the unitary sleepwear is generally indicated at 14 in FIGS. 1 and 3. It is flat, in the sense that it may be laid out on a flat surface; and it is flexible so that it may be rolled and folded. It is of such size that it can reach from the waist of the wearer, preferably down to below the wearer's feet. In the lateral dimension, it terminates in edges 36 and 38, and in the up and down direction, it terminates in top edge 40 and bottom edge 42. The width of the blanket portion is wide enough to extend around under the arms of the night garment and overlap at the back of the night garment. The overlap of the edges of the blanket is in the back thereof. There is seam around the upper edge of the blanket, as seen in FIGS. 2 and 3, and in this seam are secured the other halves of the detachable snap fasteners which are joined with the snaps 28, 30, 32 and 34. The corresponding fastener halves are generally indicated at 44, 46, 48 and 50, with the fastener half 50 attaching to snap 34. In order to maintain the overlapped edges in place, snap 52 cooperates and detachably attaches to fastener half 54, which is on the upper inside corner of the blanket of the unitary sleepwear.

In addition, as an optional closure for smaller children, the bottom edge 42 of the blanket of the unitary sleepwear may be equipped with a drawstring 56. The drawstring extends all the way through a seam on the lower portion of the blanket and, in children where the mobility thereof is not desired or required, the drawstring can be pulled tight after the lower portion is attached. This keeps the covering on the wearer's legs and feet. In such a case, the length of the blanket must be sufficient to reach below the feet of the wearer, and as a consequence, is more likely to be used for smaller children.

In use, the unitary sleepwear of this invention is usually utilized for children. In such a case, the upper night garment is put on early in the evening when the child is first prepared for bed, but he may still be somewhat active prior to actually going to bed. The upper night garment provides good mobility for the child so that he will not stumble over a long night garment. When bedtime arrives, the blanket portion of the garment is wrapped around the child and the night garment, and the fasteners are secured with the fastener halves respectively attaching to the snaps. The overlap of the blanket is closed at the back. Should the child be small and not be expected to get up during the night and the night is cold, the drawstring can be pulled tight and tied to keep the child's feet and legs fully covered and warm.

In the morning, the blanket portion of the unitary sleepwear can be unsnapped and removed so the child is again garbed only in the night garment portion thereof. In this way, warmth is maintained at night, and when the blanket portion of the unitary sleepwear is removed, the night garment can continue to be worn.

The fabric of the blanket of the unitary sleepwear may be of the same nature as the night garment, for example, a flannel. However, the blanket portion may be of heavier fabric such as blanket material, or may be a quilted, multi-layer assembly with a smooth close-weave fabric over an inner layer, with the entire assembly quilted together. In general, the upper night garment of the unitary sleepwear should be more flexible, and the lower blanket should be warmer because the night garment is worn in other uses than strictly in bed, while the blanket is worn principally in bed and immediately before and after bedtime.

This invention has been disclosed in its most preferred embodiment, and it is clear that it is susceptible to numerous modifications and embodiments within the ability of those skilled in the art and without the exercise of the inventive faculty. Accordingly, the scope of this invention is defined by the scope of the following claims.

What is claimed is:

1. Unitary sleepwear comprising:

an upper night garment and a lower blanket, said night garment and blanket being detachably attachable together;

said night garment having a torso for embracing the upper body of the wear, and having shoulders on the upper part of said torso of said garment so as to engage over the shoulders of the wearer;

fastener parts attached to said upper night garment;

said blanket of said sleepwear being formed of a flexible cloth material and being sufficiently wide to fully wrap around said torso of said night garment, said night garment having a cooperative fastener parts thereon corresponding to said fastener parts on said blanket so that said blanket may be wrapped around said upper night garment to leave an open bottom to said sleepwear and said blanket is detachably attached to said upper night garment to cover the lower part of the wearer's body.

2. The unitary sleepwear of claim 1 wherein said night garment has sleeves thereon, and some of said fastener parts are secured on said night garment below said sleeves on said torso.

3. The unitary sleepwear of claim 2 wherein said blanket is sufficiently long so that it overlies a portion of said torso of said night garment and said blanket has a bottom edge with a blanket for closing said blanket at its lower edge.

4. The unitary sleepwear of claim 3 wherein said means for closing is a drawstring in said bottom edge of said blanket.

5. Unitary sleepwear comprising:

an upper night garment, said night garment having a torso and shoulder embracing fabric for night wear, a plurality of fastener parts on said torso of said night garment;

a lower blanket, said blanket being made of flexible fabric and being of substantially rectangular configuration, said blanket having a top edge, said top edge being sufficiently long so that said blanket can be wrapped around said torso of said night garment, said top edge of said blanket having fastener parts thereon corresponding to said fastener parts on said night garment so that said blanket may be detachably attached to said night garment.

6. The unitary sleepwear of claim 5 wherein said blanket is sufficiently long so that it overlies a portion of said torso when wrapped around said torso of said upper night garment.

7. The unitary sleepwear of claim 6 wherein there are snaps on said blanket for interengaging with each other to hold in place said overlap of said blanket.

8. The unitary sleepwear of claim 7 wherein said blanket has a bottom edge, and the distance between said top edge and said bottom edge is sufficiently long so that said bottom edge extends below the feet of the wearer of said unitary sleepwear.

9. The unitary sleepwear of claim 8 wherein there is a drawstring in said bottom edge of said blanket so that said bottom edge can be pulled together under the feet of the wearer.

10. The unitary sleepwear of Claim 9 wherein said night garment has sleeves thereon and said sleeves are attached to said torso of said night garment sufficiently high so that said sleeves extend over the top of said blanket when said blanket is attached to said upper night garment.

11. Unitary sleepwear comprising:

an upper night garment, said night garment having a torso and shoulder embracing fabric for night wear, sleeves on said night garment, a plurality of fastener parts on said torso of said night garment;

a lower blanket, said blanket being made of flexible fabric and being of substantially rectangular configuration, said blanket having a top edge, said top edge being sufficiently long so that said blanket can be wrapped around said torso of said night garment, said top edge of said blanket having fastener parts thereon corresponding to said fastener parts on said night garment so that said blanket may be detachably attached to said night garment, said blanket attaching to said night garment underneath said sleeves so that the wearer's arms are free of said blanket of said unitary sleepwear.

* * * * *